United States Patent [19]

Deering

[11] Patent Number: 4,604,019

[45] Date of Patent: Aug. 5, 1986

[54] SYSTEM FOR REMOVING SOLIDS FROM A SOLIDS UPFLOW VESSEL

[75] Inventor: Roland F. Deering, Brea, Calif.

[73] Assignee: Union Oil Company of California, Los Angeles, Calif.

[21] Appl. No.: 633,806

[22] Filed: Jul. 24, 1984

[51] Int. Cl.[4] ..... F23K 3/00

[52] U.S. Cl. ..... 414/187; 414/198; 414/216; 110/167; 110/290; 48/86 A; 202/262

[58] Field of Search ..... 414/160, 187, 198, 216; 48/86 A, 87; 202/262, 263; 110/165 R, 166, 167, 169, 290

[56] References Cited

U.S. PATENT DOCUMENTS

| | | | |
|---|---|---|---|
| 2,895,884 | 7/1959 | Switzer | 414/187 X |
| 2,980,592 | 4/1961 | Deering et al. | 202/262 X |
| 3,361,644 | 1/1968 | Deering | 201/29 |
| 3,908,865 | 9/1975 | Day | 222/135 |
| 4,003,797 | 1/1977 | Cheadle et al. | 201/28 |
| 4,037,736 | 7/1977 | Pownall et al. | 414/173 |
| 4,155,476 | 5/1979 | Lipiec et al. | 105/163 R |
| 4,249,855 | 2/1981 | Dhondt | 414/198 X |

*Primary Examiner*—Robert J. Spar
*Assistant Examiner*—Ken Muncy
*Attorney, Agent, or Firm*—Yale S. Finkle; Dean Sandford; Gregory F. Wirzbicki

[57] ABSTRACT

An apparatus for removing solids from a solids upflow vessel, preferably an upflow retort, which includes a horizontally reciprocatable carriage containing a vertical feed cylinder that extends downward from a horizontal seal plate. A vertically reciprocatable piston is located inside the feed cylinder. One section of the seal plate contains a hole and a sliding door for opening and closing the hole. During normal operations when the apparatus is used to feed solids from a feed chute to an upflow vessel, the carriage is reciprocated between a first stationary position wherein the feed cylinder is aligned with the outlet of the solids feed chute while at least a portion of the closed hole in the seal plate is aligned with and below the inlet to the upflow vessel, and a second stationary position wherein the feed cylinder is aligned with the inlet to the upflow vessel while another section of the seal plate is aligned with the outlet from the feed chute. A tram-like suspension system moveably supports the carriage from elevated structural rails. When it is desired to remove solids from the upflow vessel during a maintenance shutdown, the hole in the seal plate is opened and the carriage is moved between its first and second stationary positions such that at least a portion of the open hole is aligned with and below the inlet to the upflow vessel.

14 Claims, 6 Drawing Figures

SYSTEM FOR REMOVING SOLIDS FROM A SOLIDS UPFLOW VESSEL

BACKGROUND OF THE INVENTION

This invention relates to solids handling and is particularly concerned with an apparatus for removing solids from a solids upflow vessel, such as a vertical solids upflow retort used for pyrolyzing kerogen-containing oil shale to produce hydrocarbon liquids and gases.

It is known to retort oil shale and other hydrocarbon-containing solids by a technique of contacting upward flowing, hydrocarbon-containing solids with downflowing gases in a vertical retort. One such technique is disclosed in U.S. Pat. No. 3,361,644, the disclosure of which is hereby incorporated by reference in its entirety. To produce product vapors, the upward-moving bed of shale particles exchanges heat with a downflowing, hydrocarbonaceous and oxygen-free eduction or retorting gas of high specific heat introduced into the top of the retort at a temperature between about 950° F. and about 1200° F. In the upper portion of the retort, the hot eduction gas pyrolyzes the shale, thereby producing hydrogen and hydrocarbonaceous vapors. In the lower portion of the retort, the eduction gas preheats the ascending bed of hydrocarbon-containing particles to pyrolysis temperatures. As preheating continues, the eduction gas steadily decreases in temperature, condensing high boiling hydrocarbonaceous vapors into a raw oil product while leaving a product gas of relatively high BTU content. The oil and product gas are then separated, and a portion of the product gas is heated and recycled to the top of the retort for use as the eduction or retorting gas.

A number of different devices and methods for introducing particulate solids into the bottom of vertical retorts and other solids upflow vessels have been proposed. U.S. Pat. Nos. 3,361,644 and 4,249,855 disclose a solids feeding apparatus and method in which solids are introduced upwardly into the bottom of a vertical retort by means of a piston reciprocating in a feed cylinder that is oscillated between an outlet of a solids feed reservoir and the bottom solids inlet of the retort. U.S. Pat. Nos. 3,908,865 and 4,037,736 disclose solids feeding devices and methods in which particulate solids are introduced upwardly into the bottom of a vertical solids upflow vessel by means of twin pistons reciprocating in twin feed cylinders that are oscillated between one or more solids feed chutes and the bottom solids inlet of the solids upflow vessel.

A major problem associated with the solids upflow systems described above is that there is no fully satisfactory method for removing the solids from the solids upflow vessel during maintenance turnarounds. The most commonly encountered system for removing solids from upright vessels consists of nozzles welded onto the bottom of the vessel or onto the side of the vessel near the bottom. This approach, however, is unsatisfactory in the case of the systems described above. Nozzles cannot be located at the very bottom of the upflow vessel because they would interfere with the oscillation of the feeding device between the outlet of the feed reservoir and the bottom solids inlet to the retort. Moreover, installing nozzles on the sides of the retort near the bottom would be difficult and costly because of all the other equipment that surrounds the retort in this area. If the nozzles were located higher on the sides of the retort above the other associated equipment, the entire vessel could not be emptied by draining the solids through the nozzles. Some solids would remain in the vessel below the level of the nozzles. In addition, if nozzles were used, it would be difficult to control the flow of the solids out of the vessel without the use of relatively expensive solids flow controlling devices.

Accordingly, it is one of the objects of the present invention to provide an apparatus for removing substantially all solids from a solids upflow vessel without the use of drainage nozzles. It is another object of the invention to provide an apparatus for inexpensively controlling the rate of flow of solids as they are removed from a solids upflow vessel. These and other objects of the invention will become more apparent in view of the following description of the invention.

SUMMARY OF THE INVENTION

The present invention provides an apparatus useful for removing solids from a solids upflow vessel having a bottom solids inlet in the same horizontal plane as the outlet from a solids feed chute. The apparatus includes a carriage positioned below the solids upflow vessel and the solids feed chute. The carriage contains a substantially horizontal plate means for preventing the flow of solids from the feed chute through the solids outlet and from the upflow vessel through the bottom solids inlet. The plate means contains a hole for allowing solids to flow from the upflow vessel through the bottom solids inlet when it is desired to remove solids from the upflow vessel. Also forming part of the carriage is a means for opening and closing the hole in the plate means so that the hole can be closed during normal operations of the apparatus but open when it is desired to drain solids from the upflow vessel. The carriage also contains means for moving it in a horizontal direction between first and second stationary positions.

In addition to the carriage, the apparatus of the invention includes a carriage actuator means for horizontally reciprocating the carriage between the first and second stationary positions, a structural means for supporting the carriage in its horizontal movement between the first and second stationary positions and means for vertically feeding solids through the plate means and the bottom solids inlet into the upflow vessel. The feeding means is mounted on the carriage such that, when the carriage is in its first stationary position, the feeding means is aligned with and immediately below the solids outlet while at least a portion of the hole, which is closed during normal operations of the apparatus, is immediately below the bottom solids inlet. When the carriage is in its second stationary position, the feeding means is aligned with and immediately below the bottom solids inlet while a portion of the plate means that does not contain the hole is immediately below the solids outlet to prevent solids flow therefrom.

In a preferred embodiment of the invention, the plate means will be a metal seal plate containing a circular opening in its center through which solids are fed into the upflow vessel. The hole in the seal plate through which the solids flow when the vessel is emptied is rectangular in shape and situated at one end of the seal plate such that the lengthwise center line of the seal plate is parallel to the longer sides of the rectangular hole and divides the hole into two equal sections. The hole is opened and closed by a door which slides in and out of the seal plate. When the apparatus of the invention is used to feed solids from the feed chute outlet into the inlet of the upflow vessel, the sliding door completely covers the hole. When it is desired to empty the solids upflow vessel, the carriage is moved to its second stationary position wherein the end of the seal plate that does not contain the hole prevents solids from moving downwardly through the feed chute outlet while the feeding means prevent solids from moving downwardly through the inlet to the upflow vessel. The rectangular door which covers the hole is slid outward, thereby opening the hole. The carriage is then partially reciprocated towards its first stationary position such that a portion of the uncovered hole is below the bottom solids inlet to the upflow vessel. When this occurs, the solids in the vessel will flow downwardly by gravity through the open portion of the hole thus emptying the upflow vessel. The rate of flow of the solids from the vessel is controlled by adjusting the portion of the opened hole which is below the inlet to the upflow vessel.

DETAILED DESCRIPTION OF THE INVENTION

Figure 1:
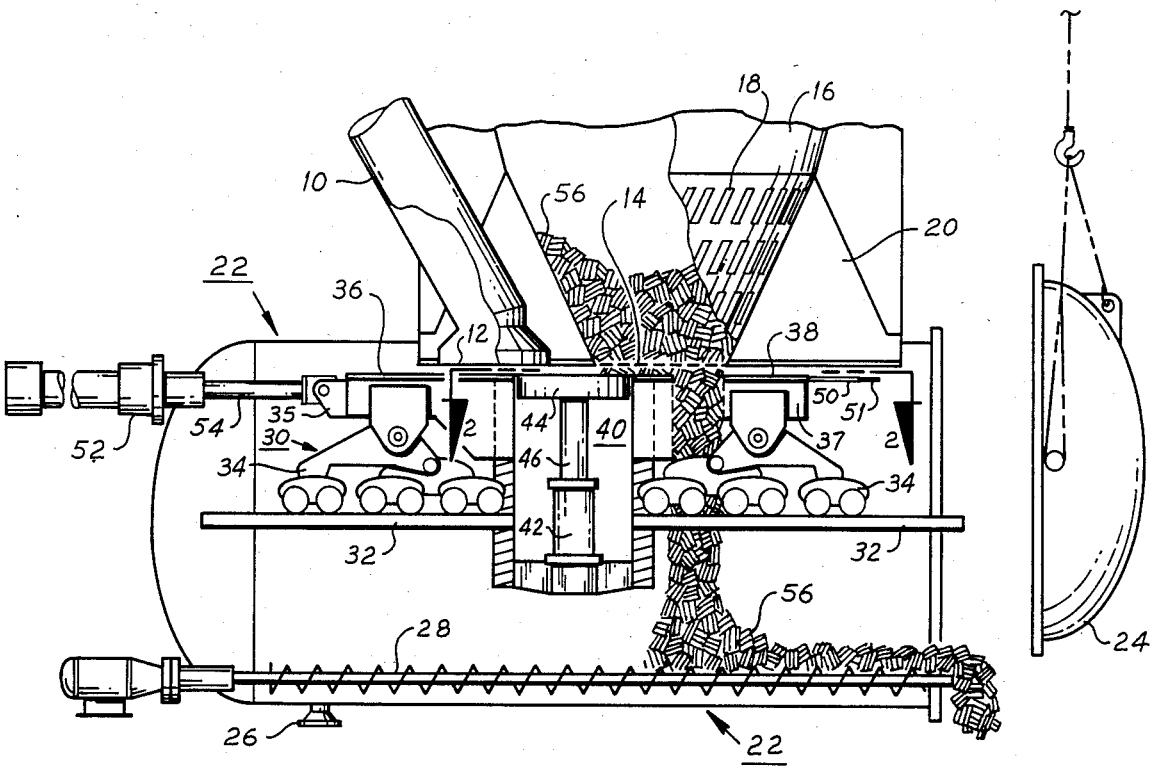
FIG. 1 in the drawing is an elevational view in vertical cross-section showing one embodiment of the apparatus of the invention.

The apparatus of the invention can be used in a variety of systems in which particulate solids are introduced upwardly into the bottom of a solids upflow vessel, and is particularly useful in a system wherein kerogen-containing oil shale solids or other hydrocarbon-containing solids are introduced into a vertical solids upflow, retort where the solids are pyrolyzed by contact with a downwardly flowing hot gas. It will be understood, however, that the apparatus of the invention is not limited to use in such a retorting system. For example, the invention can be used in a system wherein synthesis gas is produced by the reaction of a gas containing steam with carbonaceous solids such as coal, coke and the like.

Referring to FIGS. 1 through 6, feed chute 10 contains a bottom solids outlet 12 which is in substantially the same horizontal plane as the bottom solids inlet 14 of upflow vessel 16. Upflow vessel 16, only the bottom portion of which is shown, is a frusto-conical retort vessel designed for the thermal treatment of upwardly flowing solids by direct contact heat exchange with a downwardly flowing pyrolysis gas as described in U.S. Pat. Nos. 2,966,446; 3,361,644; 4,003,797; 4,004,982; 4,010,092 and 4,043,897, the disclosures of which are hereby incorporated by reference in their entireties. Disengaging section 20 is a fluid-tight compartment connected to the bottom of retort vessel 16 and is in fluid communication with the retort vessel by means of slots 18. Gases and liquids flowing downwardly through retort 16 pass through the slots and enter the disengaging section 20. Here the gases are separated from the liquids and removed from the disengaging section through a gas outlet pipe not shown in the drawing. A portion of the gases may be recycled to the top of the retort vessel to serve as the pyrolysis or retort gas. Liquids are recovered from the disengaging section through a liquid outlet pipe, which is also not shown in the drawing.

A substantially fluid-tight feeder housing, indicated generally by reference numeral 22, is positioned below retort vessel 16 and communicates with feed chute 10 through solid outlet 12 and with retort vessel 16 through solids inlet 14. The feeder housing includes removable head 24 and outlet nozzle 26. A screw conveyer 28 is located at the bottom of feeder housing 22 and is used for removing fine particulate matter that enters the feeder housing through solids outlet 12 or solids inlet 14 and settles to the bottom of housing 22.

A carriage assembly, indicated generally by reference numeral 30, is located inside feeder housing 22 and is supported from elevated structural rails 32 by a tram-like suspension system 34. Carriage assembly 30 contains a horizontal plate 33 immediately below the horizontal plane in which solids outlet 12 and solids inlet 14 terminate. The horizontal plate consists of left seal plate 36 and right seal plate 38. The seal plates are mounted on the top of the upper decks 35 and 37, respectively. Vertical feed cylinder 40 is mounted between seal plates 36 and 38 such that the top of the feed cylinder is substantially flush with the tops of the seal plates. The inside diameter of the feed cylinder is preferably substantially the same as or slightly smaller than the diameter of solids inlet 14. Hydraulic cylinder 42 is mounted inside feed cylinder 40 such that it can vertically reciprocate solids feed piston 44 by means of piston actuater shaft 46 between at least two piston positions in feed cylinder 40. Normally, a wear plate is attached to top of the feed piston to increase the life of the surface.

Structural rails 32 are mounted inside feeder housing 22 on opposite sides of feed cylinder 40 so as to be substantially horizontal and parallel to a horizontal axis passing through the center of solids outlet 12 and solids inlet 14. The structural rails are elevated a substantial distance above the bottom of the feeder housing so that the tram-like suspension system will be considerably less subject to excessive wear due to particulates accumulating inside the feeder housing and depositing on the rails.

Right seal plate 38 contains a rectangular hole 48, which can be opened and closed by sliding door 50 into or out of the seal plate using door handle 51. When the apparatus of the invention is used to feed solids from the feed chute 10 into retort 16 as illustrated in FIGS. 3 through 6, slidable door 50 entirely covers opening 48. When it is desired to drain solids from the retort as shown in FIG. 1, the slidable door is pulled out, thereby exposing all or a portion of opening 48 so that solids can flow from the retort through the uncovered portion of the hole in seal plate 38. It will be understood that the apparatus of the invention is not limited to the use of a rectangular hole or opening. Any shape of opening can be used. Furthermore, the apparatus of the invention is not limited to the use of a slidable door as a means for covering the hole. Any means for opening and closing the hole may be used.

Carriage assembly 30 is horizontally reciprocated along rails 32 by carriage actuating shaft 54, which extends into feeder housing 22 from hydraulic cylinder 52 mounted exterior to the feeder housing. The carriage actuator shaft is attached by a pin joint, not shown in the drawing, to the upper deck 35 of the carriage assembly 30. Hydraulic cylinder 52 reciprocates the carriage along rails 32 between a first carriage position shown in FIG. 3 wherein feed cylinder 40 is axially aligned with and immediately below solids outlet 12 while right seal plate 38 with hole 48 covered is immediately below solids inlet 14 to prevent flow of solids therefrom, and a second carriage position shown in FIG. 6 wherein the feed cylinder is axially aligned with and immediately below solids inlet 14 while left seal plate 36 is immediately below solids outlet 12 to prevent flow of solids through the outlet.

Figure 4:
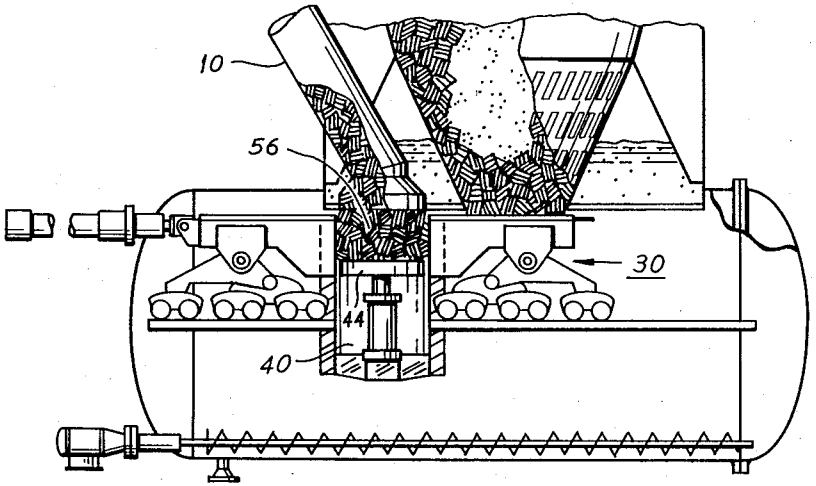
FIGS. 3 through 6 are elevational views in partial cross-section of the apparatus of the invention and associated equipment which illustrates one cycle in the process of using the invention to feed solids to a solids upflow vessel.
Figure 6:
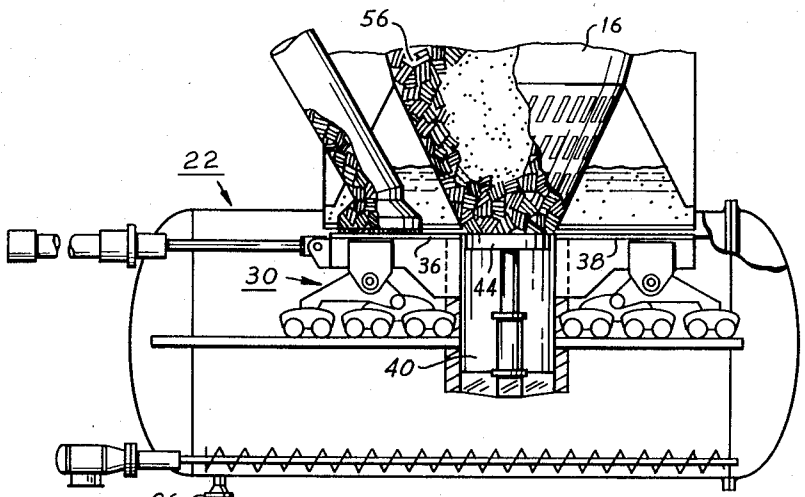
Figure 3:
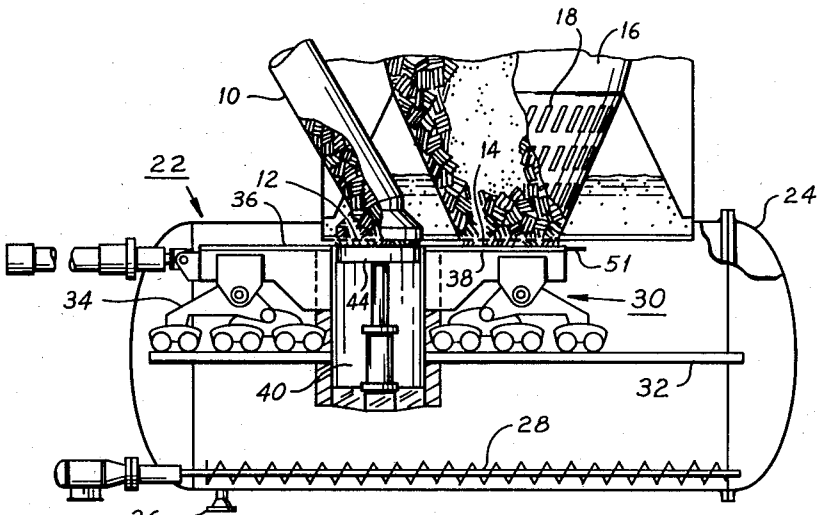
Figure 5:
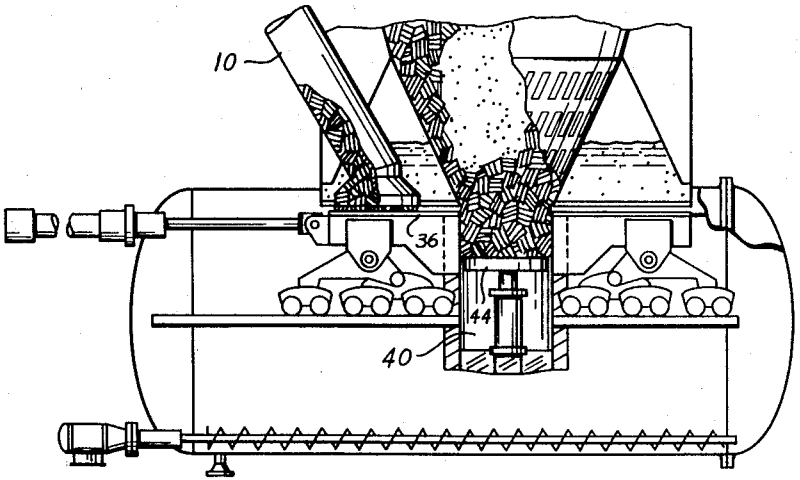

FIGS. 3 through 6 in the drawing show the apparatus of the invention as it performs one cycle in the process of feeding particulate solids from feed chute 10 into upflow vessel or retort 16. During the feeding mode, hole or opening 48 in right seal plate 38 is completely covered with slidable door 50. FIG. 3 depicts the position of the carriage assembly at the begining of a feeding cycle. The assembly is positioned in its first stationary position wherein feed cylinder 40 is immediately below and in axial alignment with solids outlet 12. Piston 44 is in its upwardmost position such that the top of the piston is flush with the top surface of seal plates 36 and 38. Right seal plate 38 containing covered hole 48 is immediately below and in axial alignment with solids inlet 14 and prevents the flow of solids from vessel 16. In the first step of a feeding cycle, as illustrated in FIG. 4, piston 44 is retracted a selected distance within feed cylinder 40 thereby permitting particulate solids 56 to flow by gravity from feed chute 10 through solids outlet 12 into the feed cylinder. The distance between the top of the feed cylinder and the top of the piston determines the amount of solids charged into the feed cylinder. After the feed cylinder is filled with solids, carriage assembly 30 is moved from the first carriage position into the second carriage position as illustrated in FIG. 5. In this position, left seal plate 36 is immediately below and in axial alignment with solids outlet 12 thereby preventing flow of particulate solids through feed chute 10. Feed cylinder 40 with piston 44 in its retracted position and filled with particulate solids is immediately below and in axial alignment with solids inlet 14. FIG. 6 illustrates the final step in one cycle of feeding solids. In this step, piston 44 is extended upward so as to displace the charge of solids from the feed cylinder 40 upwardly through solids inlet 14 into retort vessel 16. Subsequently, with piston 44 still in an extended position, carriage assembly 30 is returned to the first carriage position as illustrated in FIG. 3 and is then ready to repeat the feeding cycle. Normally, the feeding cycle is repeated a plurality of times at a speed selected to charge solids into the retort vessel at a desired rate.

Carriage assembly 30 is reciprocated between first and second stationary positions so that solids are continuously fed from feed chute 10 into retort 16 while the upflowing solids in the retort undergo pyrolysis by contact with a downflowing gas. When it is desired to shut-down the retorting process for equipment maintenance, the reciprocation of the carriage is stopped so that the carriage is normally in the position shown in FIG. 6. Before maintenance can be performed on the equipment utilized in the process, it is necessary to remove the solids 56 that remain in retort 16. Conventional methods for removing solids from vessels would normally involve draining the solids through nozzles located on or near the bottom of the vessel. As can be seen from FIG. 6, however, there is no convenient place on or near the bottom of retort 16 to install nozzles.

It has now been found that the solids can be removed from the retort by providing the seal plate on the opposite side of the carriage assembly from the feed chute with a hole which can be opened and closed. After the process has been shut-down and the carriage assembly is in the position shown in FIG. 6, the hole can be opened and the carriage assembly partially reciprocated toward its first stationary position as shown in FIG. 1. Part of the hole in the seal plate will then be under the bottom of the retort and the solids in the retort will gravitate through the solids inlet into the feeder housing, thereby emptying the retort.

When a run of the retorting process is terminated to perform maintenance on the retorting equipment, carriage assembly 30 will be in the position shown in FIG. 6 and feeder housing 22 will be filled with hydrocarbon liquids. Before the solids 56 can be emptied from the retort, the liquids are removed from feeder housing 22 through nozzle 26. Hot water is then circulated inside the feeder housing by a system of spray nozzles, not shown in the drawing, to wash out residual oil. Once the feeder housing has been cleaned, head 24 is detached from the housing as shown in FIG. 1. A maintenance person can then enter the feeder housing to unbolt the rectangular door 50 which covers hole 48 in right seal plate 38. Once the bolts are removed, door handle 51 is used to slide door 50 outwardly and expose all or a portion of hole 48. Although FIGS. 1 and 2 in the drawing show that door 50 is slid outwardly such that only a portion of hole 48 is exposed, it may be desirable in some cases to completely open hole 48 by removing the door from seal plate 38. After all or a portion of hole 48 is exposed, carriage assembly 30 is moved from its second stationary position as shown in FIG. 6 toward its first stationary position as shown in FIG. 3 until the open portion of hole 48 is underneath solids inlet 14 to retort 16. Once the carriage is in this position, solids 56 in the retort will flow by gravity through solids inlet 14 and hole 48 into the bottom of feeder housing 22. The rate at which the solids flow out of the retort is regulated by the portion of opening 48 that is under solids inlet 14. Carriage assembly 30 can be moved toward its first stationary position to increase the portion of the opening below the solids inlet or toward its second stationary position to decrease the portion of the opening below the solids inlet depending upon the desired rate of solids flow from the vessel.

Figure 2:
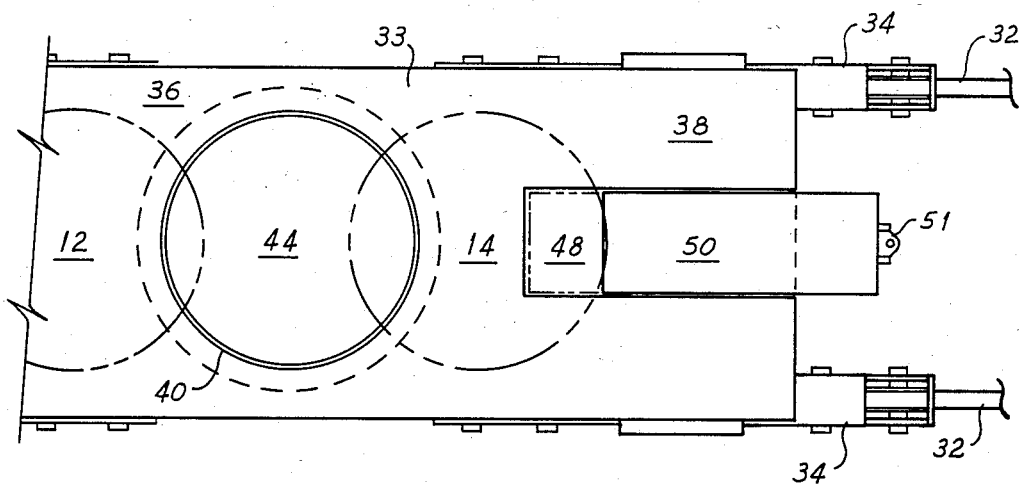
FIG. 2 is an enlarged top view of a carriage assembly which is part of the apparatus of the invention taken along the line 2—2.

FIG. 2 is a top view of the carriage assembly showing slidable door 50 in a partially retracted position exposing a portion of hole 48. The dashed circles indicate the location of the solids outlet 12 and the bottom solids inlet 14 as they would be superimposed onto the top of the carriage assembly when it is in the position shown in FIG. 1.

Screw conveyer 28, which is normally utilized to remove fines that collect in the bottom of feeder housing 22 during operation of the retort, can be used to remove the solids that are dumped into the bottom of the feeder housing from the retort after it has been shut-down. This is normally accomplished by reversing the direction of flow of the screw conveyer and passing the solids out the end of the feeder housing from which head 24 has been removed onto a conveyer belt, not shown in the drawing. The solids are then moved by the conveyer belt to a disposal area.

After maintenance on the retorting system has been completed, slidable door 50 is pushed back into right seal plate 38 until hole 48 is completely covered. Door 50 is then bolted into place and head 24 is reattached to feeder housing 22. The retort system is made ready for start up by moving carriage assembly 30 into its first stationary position as shown in FIG. 3.

It will be apparent from the foregoing that the apparatus of the invention provides a simple system which allows for the controlled removal of solids from a solids upflow vessel. Utilization of the apparatus of the invention results in substantially complete removal of solids while eliminating the need for auxillary nozzles on or near the bottom of the upflow vessel to serve as drainage conduits for the solids.

Although the invention has been primarily described in conjunction with a preferred embodiment, it is evident that many alternatives, modifications and variations will be apparent to those skilled in the art in light of the foregoing description. Accordingly, it is intended to embrace within the invention all such alternatives, modifications and variations that fall within the spirit and scope of the appended claims.

I claim:

1. An apparatus for removing solids from a solids upflow vessel through a bottom solids inlet to said upflow vessel, said vessel being mounted adjacent to a solids feed chute having a solids outlet in substantially the same horizontal plane as said bottom solids inlet and spaced from said bottom solids inlet, which apoaratus comprises:

(a) a carriage positioned below said solids upflow vessel and said solids feed chute, said carriage carrying a substantially horizontal plate means for preventing flow of solids from said feed chute through said solds outlet and from said upflow vessel through said bottom solids inlet, said plate means containing (1) a first hole through which solids can be introduced into said upflow vessel through said bottom solids inlet, (2) a second hole through which solids can be removed from said upflow vessel through said bottom solids inlet and (3) a means for opening and closing said second hole, said carriage being further provided with means for movement in a horizontal direction between first and second stationary positions;

(b) carraige actuator means for horizontally reciprocating said carriage between said first and said second stationary positions;

(c) a structural means for supporting said carriage in its horizontal movement between said first and said second stationary positions; and (d) means for vertically feeding solids through said first hole in said plate means into said upflow vessel through said bottom solids inlet, said feeding means being mounted on said carriage such that said feeding means is aligned with and immediately below both said first hole and the solids outlet of said feed chute while at least a portion of said second hole in said plate means is immediately below the bottom solids inlet to said upflow vessel when said carriage is in said first stationary position, and said feeding means is aligned with and immediately below both said first hole and the bottom solids inlet to said upflow vessel while a portion of said plate means is immediately below the solids outlet of said feed chute when said carriage is in said second stationary position, and wherein said second hole is located in said plate means such that when at least a portion of said second hole is immediately below the bottom solids inlet to said upflow vessel and at least a portion of said second hole is uncovered, solids can flow from said upflow vessel outside the confines of said feeding means until said upflow vessel is substantially empty of solids.

2. An apparatus as defined by claim 1 wherein said solids upflow vessel comprises an oil shale retort.

3. An apparatus as defined by claim 1 wherein said hole is rectangular in shape.

4. An apparatus as defined by claim 1 wherein said means for opening and closing said hole comprises a door which can be slid into said hole to close said hole and out of said hole to open said hole.

5. An apparatus as defined by claim 1 wherein said means for movement in a horizontal direction between said first and said second stationary positions comprises a tram-like suspension system.

6. An apparatus as defined by claim 1 wherein said carriage actuator means comprises a hydraulic cylinder which activates a shaft connected to said carriage.

7. An apparatus as defined by claim 1 wherein said structural means for supporting said carriage comprises first and second substantially horizontal structural rails mounted parallel to said carriage on the opposite sides of said carriage.

8. An apparatus as defined by claim 1 wherein said feeding means mounted on said carriage comprises a solids feed piston moveably mounted in a solids feed cylinder.

9. An apparatus as defined by claim 8 wherein said feed piston is actuated by a hydraulic cylinder which actuates a shaft connected to said solids feed piston.

10. An apparatus as defined by claim 1 wherein said carriage and said structural means for supporting said carriage are encased in a substantially fluid-tight housing below said solids upflow vessel which communicates with said feed chute through said solids outlet and with said solids upflow vessel through said bottom solids inlet.

11. An apparatus for removing solids from an upflow retort through a bottom solids inlet to said upflow retort, said retort being mounted adjacent to a solids feed chute having a solids outlet is substantially the same horizontal plane as said bottom solies inlet and spaced from said bottom solids inlet along a first axis, which apparatus comprises:

(a) a carraige positioned below said upflow retort and said feed chute, said carriage having a first seal plate for preventing the flow of solids from said feed chute through said solids outlet and a second seal plate for preventing the flow of solids from said upflow retort through said bottom solids inlet, wherein said second seal plate contains an opening having a cover aligned with the top surface of said second seal plate to form a continuous surface, said cover being removable from said second seal plate to expose said opening;

(b) a structural support means;

(c) means mounted on the underside of said first and second seal plates for horizontally moving and independently supporting said carriage from said structural support means;

(d) carriage actuator means for horizontally reciprocating said carriage between first and second stationary position along a substantially horizontal second axis parallel to said first axis;

(e) a vertical solids feed cylinder mounted on said carriage between said first and second seal plates such that said feed cylinder is axially aligned with and immediately below the solids outlet of said feed chute while at least a portion of the opening in said second seal plate is axially aligned with and immediately below the bottom solids inlet to said upflow retort when said carriage is in said first stationary position, and said feed cylinder is axially aligned with and immediately below the bottom solids inlet to said upflow retort while said first seal plate is axially aligned with and immediately below the solids outlet of said feed chute when said carriage is in said second stationary position, and wherein said opening is located in said second seal plate such that when at least a portion of said opening is immediately below the bottom solids inlet to said upflow retort and at least a portion of said opening is uncovered, solids can flow from said upflow retort outside the confines of said feed cylinder until said upflow retort is substantially empty of solids;

(f) a solids feed piston moveably mounted in said solids feed cylinder; and (g) feed piston actuating means supported from said carriage for vertically reciprocating said solids feed piston within said feed cylinder.

12. An apparatus as defined by claim 11 wherein said means mounted on the underside of said first and second seal plates comprises a tram-like suspension system.

13. An apparatus as defined by claim 11 wherein said removable cover comprises a slidable door.

14. An apparatus as defined by claim 11 wherein said opening in said second seal plate is rectangular in shape.

* * * * *